US006223350B1

(12) United States Patent
McFarlane

(10) Patent No.: US 6,223,350 B1
(45) Date of Patent: May 1, 2001

(54) MOLDED KNEE PAD CONSTRUCTION

(75) Inventor: Maxwell K. McFarlane, Warrandyte (AU)

(73) Assignee: Knee-On Australia Pty Ltd., Victoria (AU)

( * ) Notice: Subject to any disclaimer, the term of this patent is extended or adjusted under 35 U.S.C. 154(b) by 0 days.

(21) Appl. No.: 09/471,344

(22) Filed: Dec. 23, 1999

(51) Int. Cl.[7] ..... A41D 13/06
(52) U.S. Cl. ..... 2/24; 602/26
(58) Field of Search ..... 2/22, 24, 242, 2/16, 23, 911, 455; 128/881, 882; 264/219, 220, 239, 500; 602/6, 26, 62

(56) References Cited

U.S. PATENT DOCUMENTS 3,587,572 * 6/1971 Evans ..... 128/80
3,772,704 * 11/1973 Carbonneau ..... 2/22
5,031,240 * 7/1991 Nierhaus ..... 2/24
5,301,370 * 4/1994 Henson ..... 2/22
5,334,135 * 8/1994 Grim et al. ..... 602/26
5,500,955 * 3/1996 Gongea ..... 2/24
5,537,689 * 7/1996 Dancyger ..... 2/24
5,794,261 * 8/1998 Hefling ..... 2/16

* cited by examiner

*Primary Examiner*—Gloria M. Hale
*Assistant Examiner*—Tejash Patel
(74) *Attorney, Agent, or Firm*—Banner & Witcoff, Ltd.

(57) ABSTRACT

A knee pad construction includes a molded, elastomeric pad with a concave back side and a multi-segmented, integrally molded shape. A retention strap is positioned on the lower ⅔ of the pad for holding the pad over a knee.

4 Claims, 6 Drawing Sheets

MOLDED KNEE PAD CONSTRUCTION

BACKGROUND OF THE INVENTION

This invention relates to a knee pad construction of the type which may be used by construction workers, mechanics, sportsmen, and others who may find it necessary to provide protection for their knees as a result of their work or other activities.

When engaging in certain work activities such as construction, mechanic repair activities, and the like, it is often necessary for a worker to position himself or herself on their knees in order to efficiently perform the work or task. Various sports also require protection for knees, including sports such as skateboarding, skating and the like. Failure to protect the knees of an individual may result in extremely harmful injuries.

Conventional protection has been provided in the form of various types of pads which are usually attached over the knee by straps or other means. Such constructions are often very uncomfortable and not always efficient. For example, the pads, or the straps holding the pads in position, may cut into the limbs of the person wearing them.

An alternative to strapped-on pads are padded clothing, such as trousers with padded knees. Such an arrangement is often not useful because of the difficulties of inserting padding in clothing and further, the fact that providing padding, which will be easily aligned and positioned over the knee, is not easily effected by means of clothing or other garments.

SUMMARY OF THE INVENTION

Briefly, the present invention comprises a cushioned knee pad construction which is molded from an elastomeric material and which has a thickness sufficient to cushion and protect a knee joint. The molded knee pad construction includes a unitary body member which has a concave back side and a front side with a convex profile, but including a generally flat midsection and further including a plurality of individual transverse segments extending from one side of the pad to the other so as to provide flexibility for the pad. The construction further includes a cushion pad on the back side conforming to the shape of the back side and an attachment strap preferably integrally incorporated with the cushion pad. The single strap preferably extends over the lower ⅔ of the knee pad construction.

Thus, it is an object of the invention to provide an improved molded knee pad construction which may be utilized by individuals of varying size and shape.

It is a further object of the invention to provide an improved, molded knee pad construction with a unique front side profile comprising segmented portions wherein a single unitary strap is attached to the concave back side of the knee pad construction for holding the knee pad against the knee or patella of an individual.

It is yet another object of the invention as to provide a knee pad construction of improved comfort and durability.

These and other objects, advantages and features of the invention will be set forth in a detailed description as follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
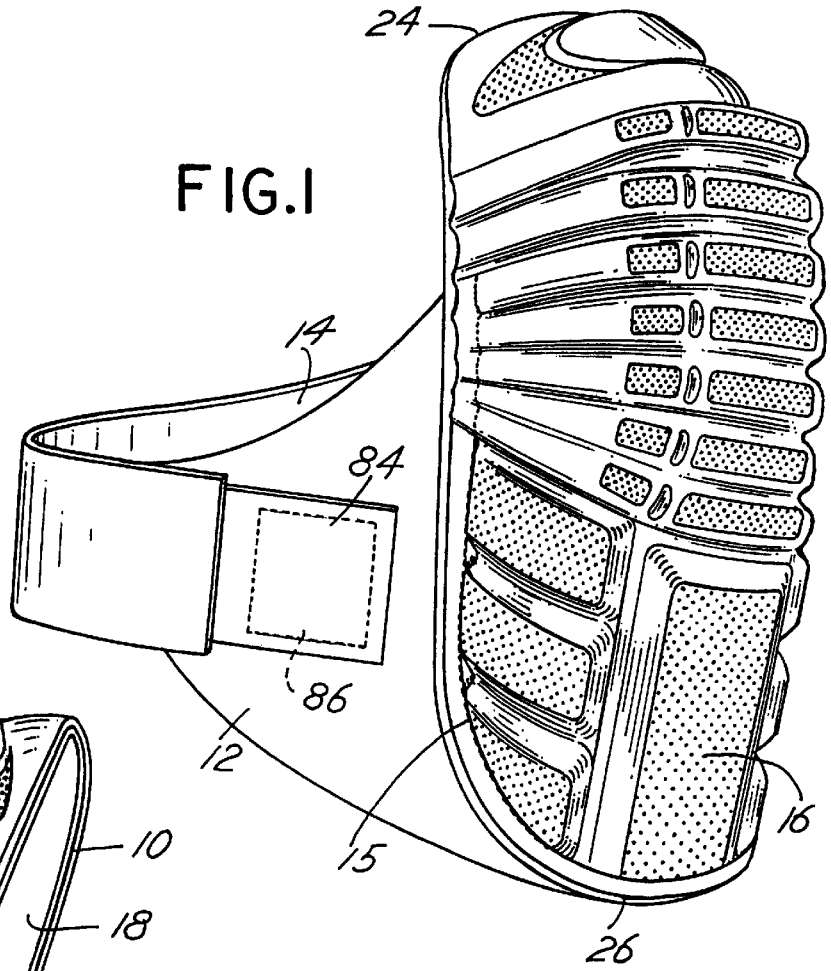
FIG. 1 is a perspective view of the knee pad construction.
Figure 2:
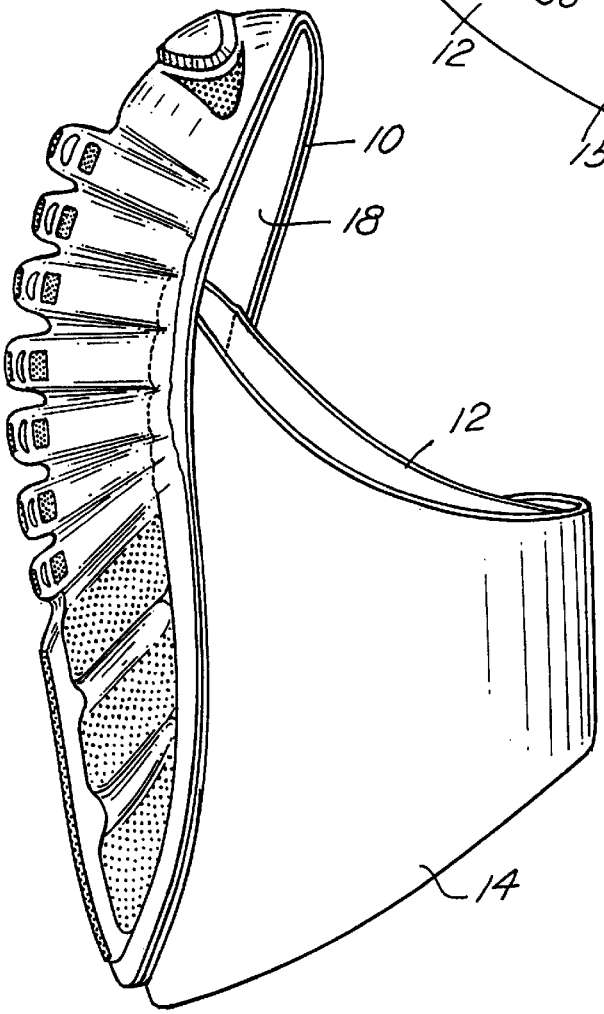
FIG. 2 is a side view of the construction of FIG. 1.
Figure 3:
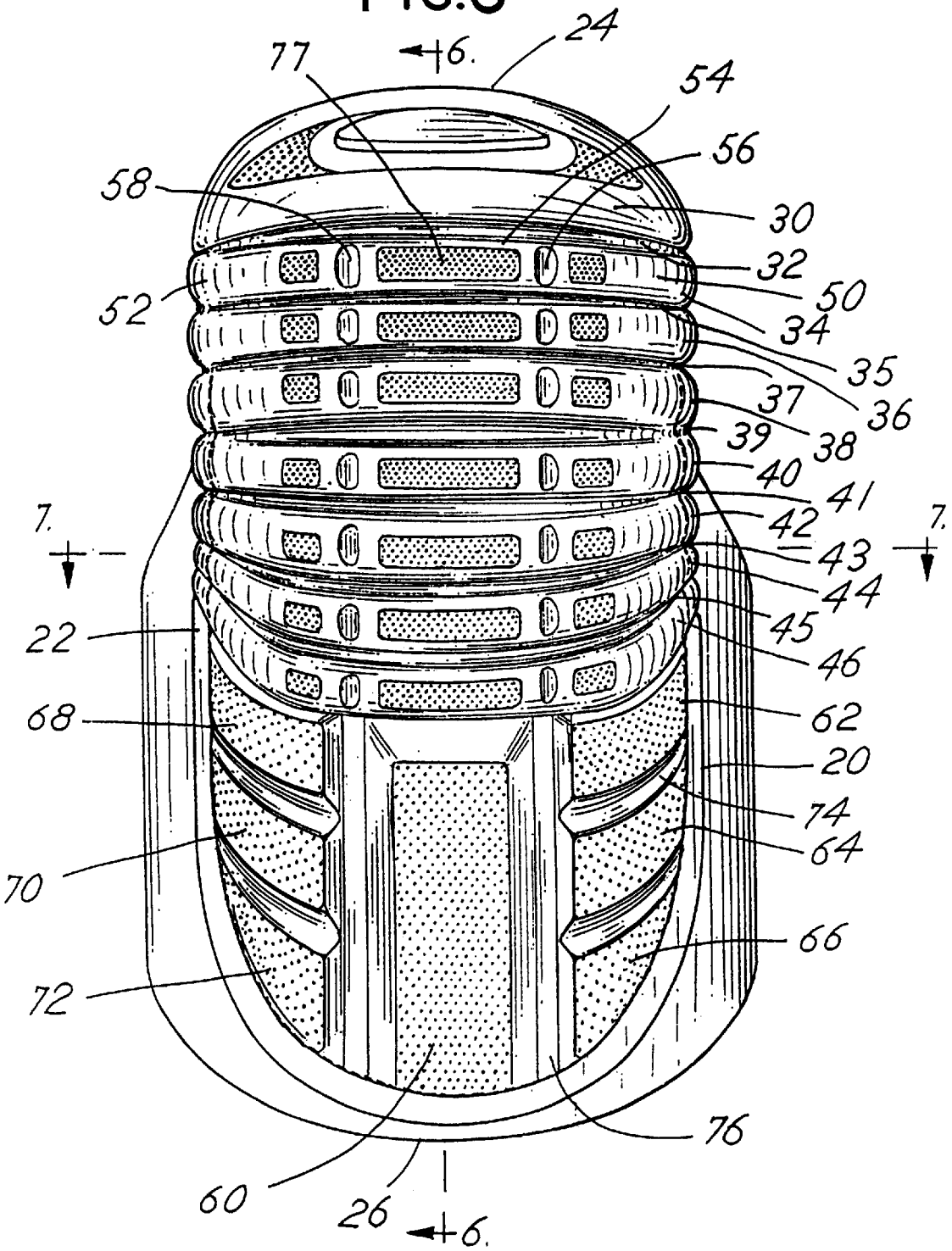
FIG. 3 is a front plan view of the construction of FIG. 1.
Figure 4:
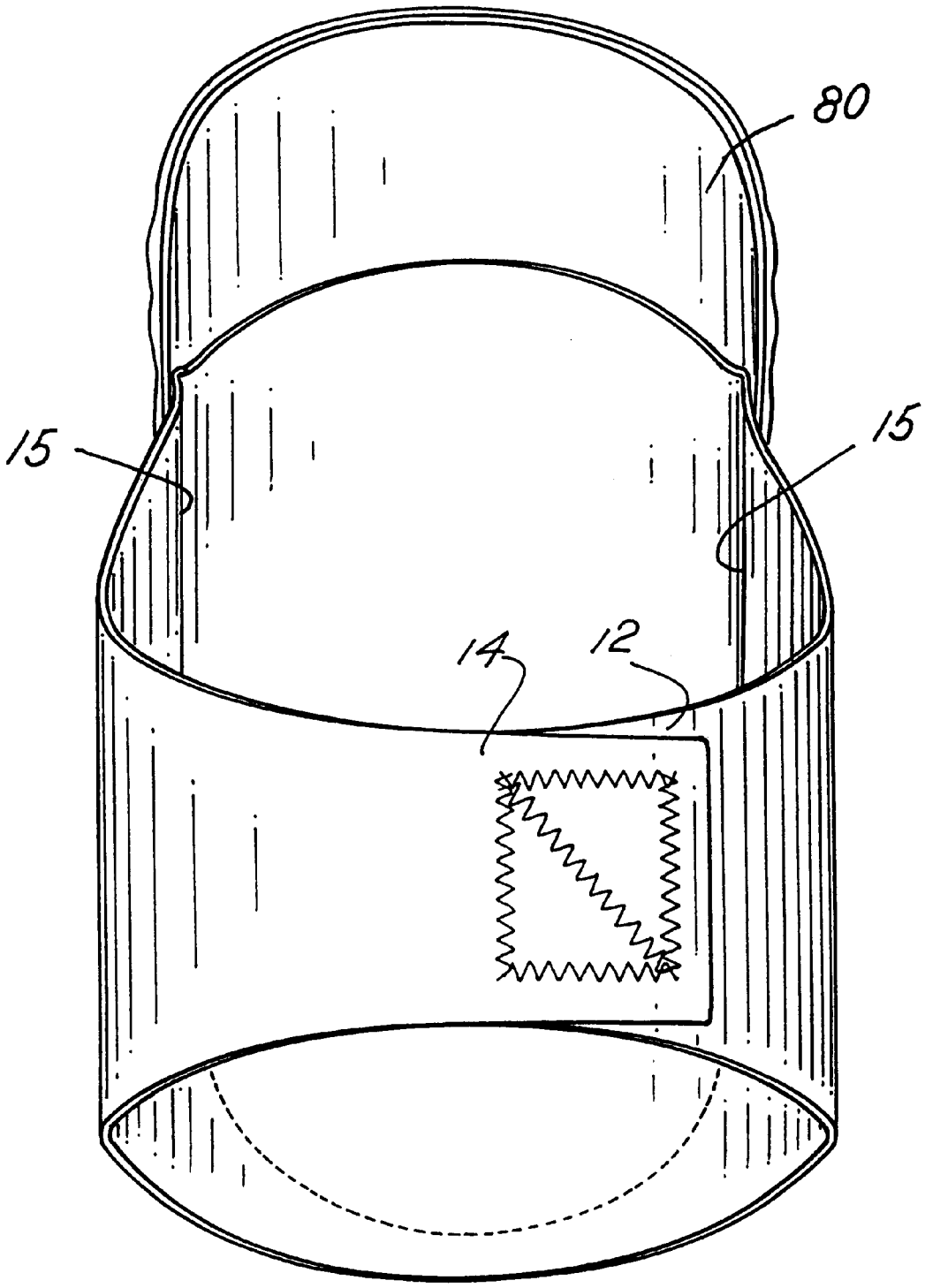
FIG. 4 is a back plan view of the construction of FIG. 1.
Figure 5:
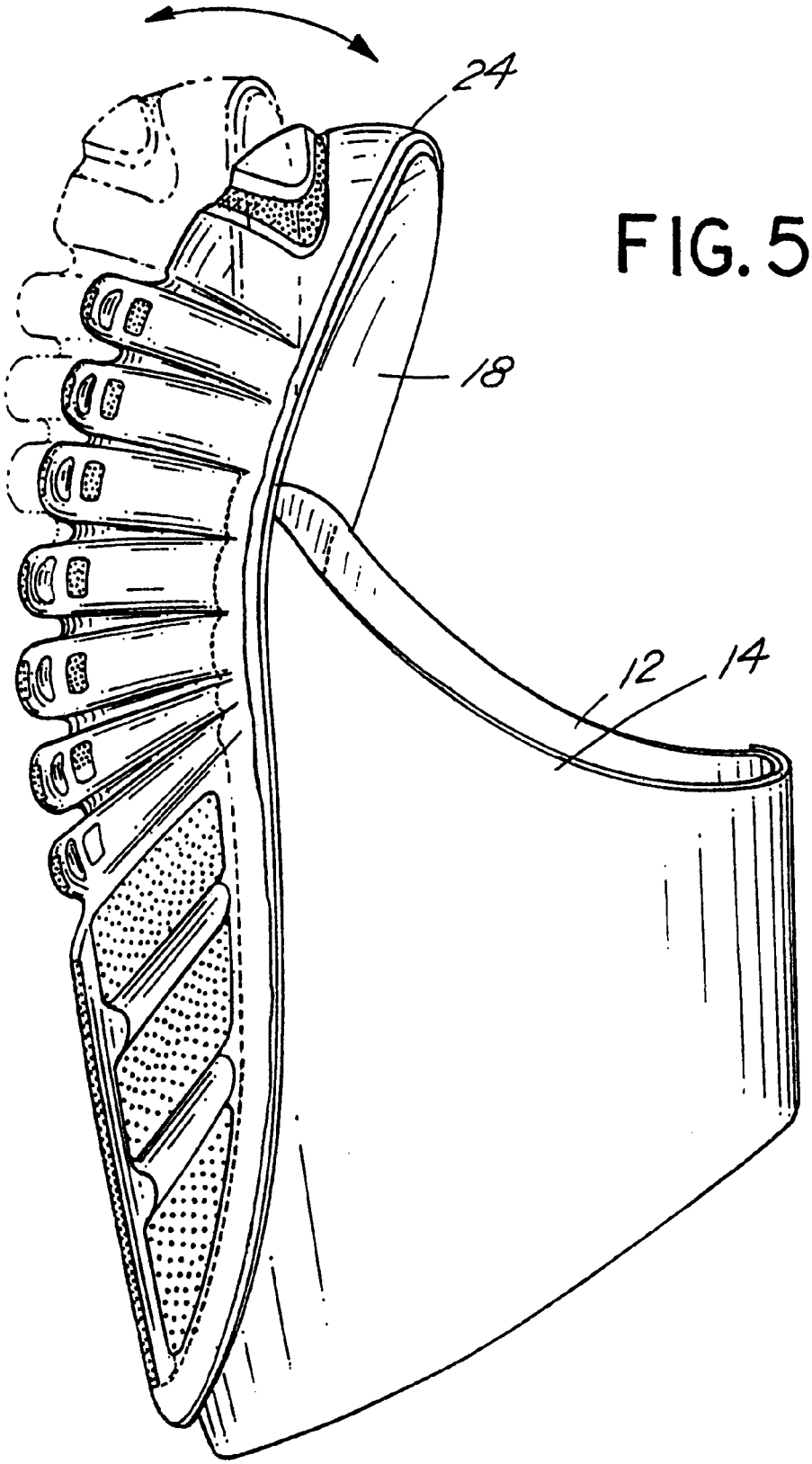
FIG. 5 is a further side view of the construction of FIG. 1 depicting the flexibility of the construction and placement thereof on a knee.
Figure 6:
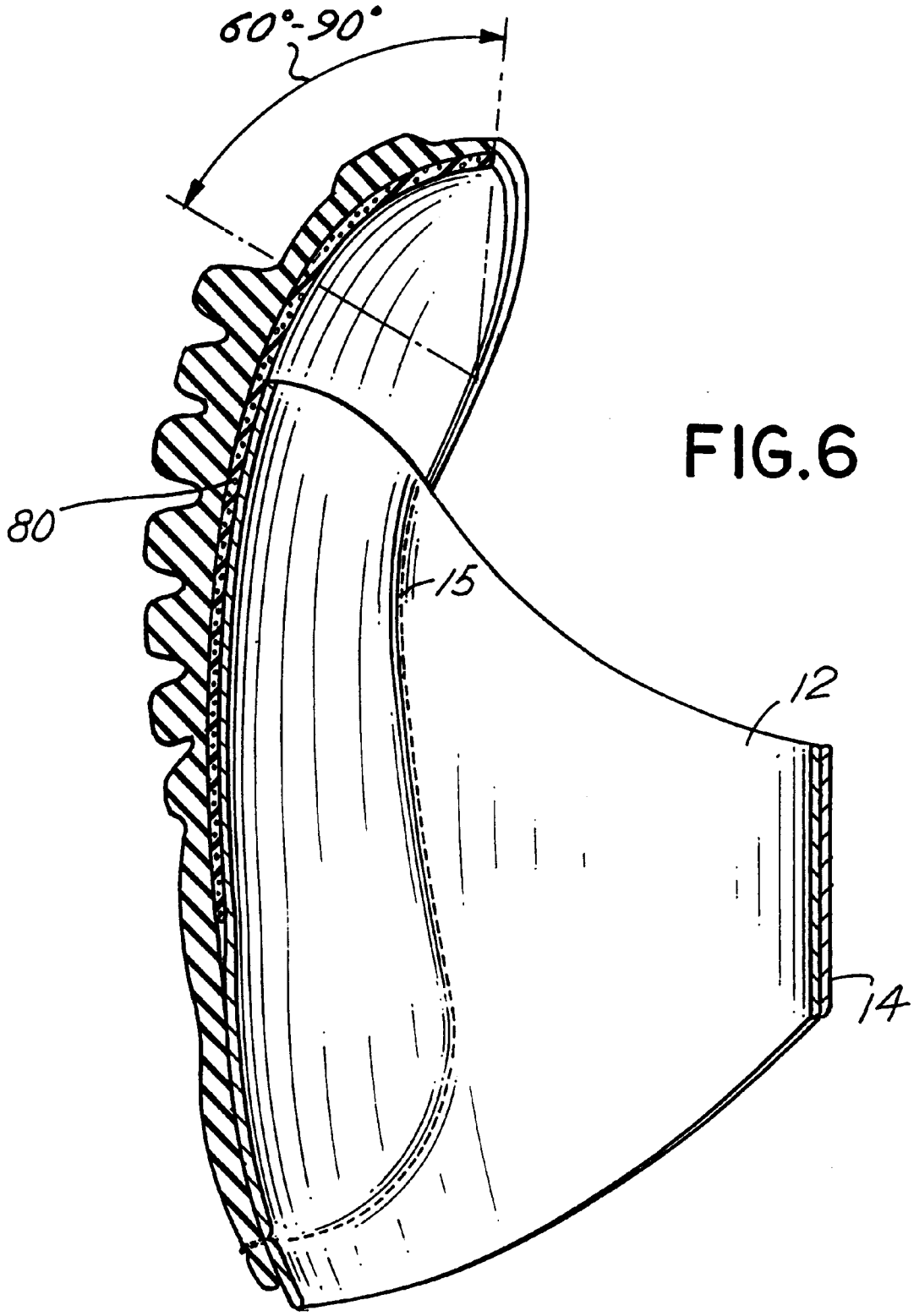
FIG. 6 is a cross sectional view of the construction along the line 6—6 in FIG. 3.
Figure 7:
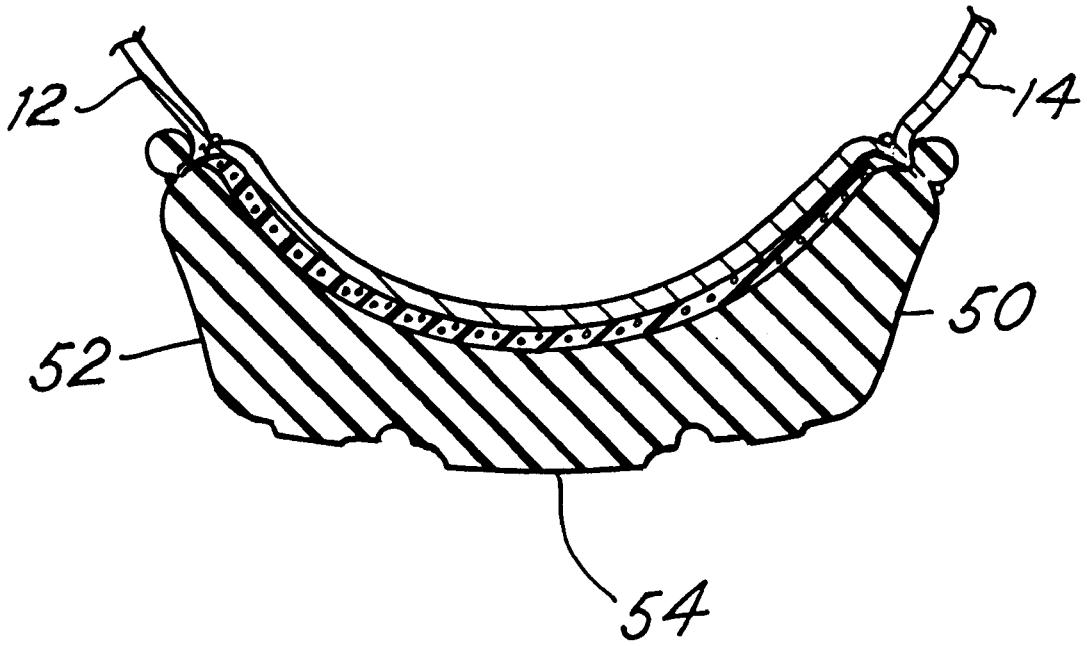
FIG. 7 is a cross sectional view of the construction along the line 7—7 in FIG. 3.

Referring to the Figures, the molded knee pad construction is comprised of a molded unitary body member 10 and flexible straps 12 and 14 which are attached by stitching 15 to the body member 10. The body member 10 is typically molded from an elastic material such as rubber. The body member 10 includes a front side 16, a back side 18, a first lateral side 20, a second lateral side 22, an upper end 24 and a lower end 26. The front side 16 is generally convex in cross section. The back side 18 is generally concave. The concave configuration of the back side 18 is formed so that the patella or knee of a human can easily fit into the construction adjacent the upper end 24 and so that the tibia or leg bone of the lower leg may be conveniently encased or encompassed, particularly in the lower ⅔ of the body member 10. Thus, the patella will fit within the upper ⅓ of the body member 10.

The body member 10 further includes a series of segments beginning with a first upper segment 30 at the upper end 24. The segment 30 is generally in the shape of a portion of a sphere defining an arc in the range of 60°–90° from the upper end toward the lower end 26. The first upper segment 30 smoothly connects with a transverse trough or recess 32. A series of seven further or intermediate segments 34, 36, 38, 40, 42, 44, 46. Each of the segments 34, 36, 38, 40, 42, 44, 46 are separated one from the other by transverse troughs or recesses 35, 37, 39 41, 43, and 45. Thus, the segments are flexible about the troughs to provide flexibility in the knee pad construction.

Each segment such as segment 34 includes a depending lateral run 50 on one side 2 and a depending lateral run 52 on the opposite side 22. Intermediate the depending runs 50, 52 is a generally flat midsection 54. The midsection 54 is separated from the depending side sections 50 and 52 by a recess 56 and 58, respectively. The recesses 56 and 58 do not extend into the body member as far as the trough 32 and/or 35. Rather, they extend approximately 40–60% of the depth of the trough 32 adjacent thereto. The midsections 54 of all the segments are generally coplanar. The first segment 34 includes a central or midsection 54 which projects upwardly from the convex surface a greater distance than that of the other segments. Thus, in order to have a planar profile of the midsections 54, the segment 32 has greater radial extent from the convex profile of the body member 10.

Adjacent the lower most segment 46 is an array of segmented lower members. The first segmented lower member includes a midsection 60 which has a planar profile. First, second and third segments 62, 64, and 66 are arranged on one side 20 of the panel 60. Similarly, on the opposite side 22 are positioned first, second and third segments 68, 70 and 72. The segments such as segment 62 and 64 are again separated by a recess 74. A vertical recess 76 separates segments 62, 64, 66 from the planar section 60.

Each of the segments, such as segment 34 includes a pattern, for example, a knurl pattern 77. The pattern 77 is provided on the midsection 54 as well as on the lateral sides 50, 52 in the preferred embodiment for each of the segments of the body member. Note that the recesses, such as recess 58 and 76 are aligned and extend along the vertical extent of the knee pad from the lower end 26 to the upper end 24.

A cushion pad 80 is affixed, for example, by adhesive to the concave underside 18 of the body member 10. The lower ⅔ of the body member 10 includes a unitary strap construction of a single piece of flexible material comprising straps 12 and 14, as well as a center section 82. The strap configuration is stitched along a stitch line 15 to the body member 10. The ends of the straps 12, 14 include fasteners 84, 86, e.g., Velcro brand fasteners which enable straps to be attached one to the other for retention about the leg of the user.

Because of the flexibility of the component parts of the knee pad construction, and because of the arrangement of the various segments described, including in particular the midsection 54, it is possible for a workman having knee pads thereon to drop easily to his/her knees and be cushioned by the engagement of the midsections 54 with a surface. The troughs, such as troughs 3 5, 3 7, etc. permit flexibility of the knee pad to accommodate an uneven surface. The upper most section 30 provides a cushioning and retention means for holding the patella (knee) in place. By providing the straps 12, 14 are arrayed on the lower ⅔ of the knee pad construction, the knee pad is retained properly in a manner which enables a worker to bend his/her knee with the straps 12, 14 retaining the pad on the leg and the upper end of the knee pad extending upwardly so as to protect the knee.

Various alternative features may be included within the knee pad construction described above. Thus, the thickness of the knee pad, in order to provide a cushioning effect, may be varied. The dimension and extent of each of the segments forming the knee pad may be varied to provide for various types of bending of the pad. Thus, the invention is to be limited only by the following claims and equivalents thereof.

What is claimed is:

1. A molded knee pad construction comprising, in combination:

a unitary, single element, body member molded from an elastomeric material and having a front side, a back side, an upper end and a lower end, and opposite lateral sides, said body member having a concave back side and a front side with a convex profile from the upper end to the lower end, and a convex profile with a generally flat midsection from one lateral side to the other, said body member further including a plurality of individual segments extending from one lateral side to the other, said segments flexibly connected and including a first upper segment defining an arc from the upper end toward the lower end in the range of 60° to 90°, a series of at least four further segments arrayed from side to side, the midsection of the four segments substantially coplanar, and at least one lower end segment, said body member including an upper ⅓ body portion and a lower ⅔ body portion;

a cushion pad on the back side conforming to the shape of the back side; and a first attachment strap attached to one lateral side and a second attachment strap attached to the other lateral side, each attachment strap extending along the lower ⅔ body portion and including a fastener for connecting the straps.

2. The knee pad construction of claim 1 wherein the further segments and the lower end segment each include a recess on each side of the midsection, said recesses being aligned and extending in parallel array from the upper end to the lower end of the pad.

3. The knee pad construction of claim 1 wherein the cushion pad and straps comprise a single integral flexible material affixed to the body member.

4. The knee pad construction of claim 1 wherein the body member comprises an upper ⅓ portion and wherein the first upper segment is positioned in the upper ⅓ portion of the body member between the attachment straps and the upper end.

* * * * *

UNITED STATES PATENT AND TRADEMARK OFFICE

CERTIFICATE OF CORRECTION

PATENT NO. : 6,223,350 B1
DATED : May 1, 2001
INVENTOR(S) : McFarlane

It is certified that error appears in the above-identified patent and that said Letters Patent is hereby corrected as shown below:

Title page,
The following information should be inserted:

Related U.S. application data
(60) Provisional application No. 60/165,502, filed on November 15, 1999.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*